US008752800B2

(12) United States Patent
Lacerte et al.

(10) Patent No.: US 8,752,800 B2
(45) Date of Patent: Jun. 17, 2014

(54) BOARD MOUNT

(75) Inventors: Marc D. Lacerte, Lighthouse Point, FL (US); Richard Nadeau, Coconut Creek, FL (US); Trevor Duhaime, Parkland, FL (US)

(73) Assignee: Board Mount Inc., Pompano Beach, FL (US)

( * ) Notice: Subject to any disclaimer, the term of this patent is extended or adjusted under 35 U.S.C. 154(b) by 0 days.

(21) Appl. No.: 13/301,108

(22) Filed: Nov. 21, 2011

(65) Prior Publication Data

US 2012/0061537 A1 Mar. 15, 2012

Related U.S. Application Data

(63) Continuation of application No. 11/970,747, filed on Jan. 8, 2008.

(51) Int. Cl.
*E04B 1/00* (2006.01)

(52) U.S. Cl.
USPC ..... 248/220.22; 52/58

(58) Field of Classification Search
USPC ..... 248/220.21, 220.22; 52/58, 60, 62, 52/302.1, 302.3, 302.6, 254, 293.1, 443, 52/446
See application file for complete search history.

(56) References Cited

U.S. PATENT DOCUMENTS

| | | | | |
|---|---|---|---|---|
| 1,337,840 A | | 4/1920 | Hawley | |
| 1,389,057 A | | 8/1921 | Lavigue | |
| 2,642,632 A | | 6/1953 | Savage | |
| 2,922,385 A | | 1/1960 | Murray | |
| 3,139,703 A | | 7/1964 | Hilt | |
| 3,358,402 A | | 12/1967 | Sahm | |
| 3,471,982 A | * | 10/1969 | Strozewski | 52/282.4 |
| 3,485,001 A | * | 12/1969 | Miller | 52/281 |
| 3,766,694 A | * | 10/1973 | Minialoff et al. | 52/95 |
| 4,073,108 A | * | 2/1978 | Williams | 52/238.1 |
| 4,302,262 A | | 11/1981 | Kay | |

(Continued)

FOREIGN PATENT DOCUMENTS

| | | |
|---|---|---|
| CA | 2711719 | 1/2009 |
| EP | 1382772 A2 | 1/2004 |
| FR | 1234649 A | 10/1960 |
| GB | 2381804 A | 5/2003 |

OTHER PUBLICATIONS

International Search Report and Written Opinion for PCT/US2009/030273, Sep. 25, 2009 (19 pages).

(Continued)

*Primary Examiner* — Steven Marsh
(74) *Attorney, Agent, or Firm* — K&L Gates LLP

(57) ABSTRACT

A board mount which can be utilized to position a board relative to a building element. In various embodiments, the board mount can include a holder for receiving at least a portion of a drywall board and, in addition, a flexible member which can be inserted intermediate first and second building elements to retain the board holder relative to one of the first and second building elements. The flexible member can be configured to be deflected, or flexed, between a first configuration and a second configuration when the flexible member is positioned intermediate the building elements. In use, the flexible member can hold the board mount in place while a laborer inserts the drywall board into the board holder. In such circumstances, an additional laborer may not be required to hold the drywall board in position as it is fastened, or otherwise secured, to the frame of the building.

3 Claims, 5 Drawing Sheets

(56) References Cited

U.S. PATENT DOCUMENTS

| | | | | |
|---|---|---|---|---|
| 4,683,622 | A | 8/1987 | Oehike | |
| 4,967,519 | A | 11/1990 | Sieber | |
| 5,079,880 | A | 1/1992 | Reid | |
| 5,802,785 | A | 9/1998 | Crook | |
| 5,918,427 | A * | 7/1999 | VanderWerf | 52/100 |
| 5,937,600 | A | 8/1999 | Larson | |
| 5,946,870 | A | 9/1999 | Bifano et al. | |
| 5,970,671 | A | 10/1999 | Bifano et al. | |
| 6,119,416 | A | 9/2000 | Larson | |
| 6,119,429 | A | 9/2000 | Bifano et al. | |
| 6,134,847 | A | 10/2000 | Bifano et al. | |
| 6,161,344 | A | 12/2000 | Blanchett | |
| 6,170,207 | B1 | 1/2001 | Saindon | |
| 6,293,064 | B1 | 9/2001 | Larson | |
| 6,298,609 | B1 | 10/2001 | Bifano et al. | |
| 6,305,130 | B1 | 10/2001 | Ackerman, Jr. | |
| 6,421,971 | B1 * | 7/2002 | Gembala | 52/302.6 |
| 6,470,638 | B1 | 10/2002 | Larson | |
| 6,622,432 | B2 | 9/2003 | Zacher et al. | |
| 6,640,508 | B2 | 11/2003 | Lindgren et al. | |
| 6,698,144 | B1 | 3/2004 | Larson | |
| 6,776,423 | B1 | 8/2004 | Guht | |
| 7,299,597 | B2 * | 11/2007 | Holt | 52/712 |
| 2003/0177725 | A1 | 9/2003 | Gatherum | |
| 2005/0257461 | A1 | 11/2005 | Day, IV | |
| 2007/0062137 | A1 | 3/2007 | Maylon | |
| 2009/0173858 | A1 | 7/2009 | Lacerte | |

OTHER PUBLICATIONS

International Preliminary Report on Patentability for PCT/US2009/030273, Jul. 22, 2010 (13 pages).

* cited by examiner

BOARD MOUNT

CROSS REFERENCE TO RELATED APPLICATION

This application is a continuation application under 35 U.S.C. §120 of U.S. patent application Ser. No. 11/970,747, entitled BOARD MOUNT, filed on Jan. 8, 2008, the entire disclosure of which is hereby incorporated by reference herein.

BACKGROUND

1. Field of the Invention

The present invention generally relates to an apparatus for mounting boards and, more particularly, to mounting drywall, gypsum board, plasterboard, rock lath, or SHEETROCK®, etc. to a building.

2. Description of the Related Art

During the construction of buildings, such as houses and office buildings, for example, boards are often fastened to the frames, or other suitable structures, of the buildings. Often, laborers must hold the boards in place while they are secured with fasteners. Such a process is labor intensive and can increase the cost to construct the building. Furthermore, especially when drywall is mounted to the frame of a building, for example, laborers often position the drywall boards against the wall studs of the frame without concern as to whether the drywall boards are aligned with other elements of the building structure, such as a window frame, for example. As a result, drywall boards are often misaligned with respect to these other building elements and significant time is often required to apply finishing compound, for example, to the drywall boards such that such misalignment is not readily noticeable. What is needed is an improvement over the foregoing.

SUMMARY

In at least one form of the invention, a board mount can be utilized to position a board relative to a building element. In various embodiments, the board mount can include a holder for receiving at least a portion of a drywall board, for example, and, in addition, a flexible member which can be inserted intermediate first and second building elements to retain the board holder relative to at least one of the first and second building elements. In at least one embodiment, the flexible member can be configured to be deflected, or flexed, between a first configuration and a second configuration when the flexible member is positioned intermediate the building elements. In use, the flexible member can hold the board mount in place while a laborer inserts the drywall board into the board holder. In such circumstances, as a result, an additional laborer may not be required to hold the drywall board in position as it is fastened, or otherwise secured, to the frame of the building.

In at least one form of the invention, the flexible member can be configured to align the board holder, and a board at least partially received therein, relative to at least one of the first and second building elements. In various circumstances, the drywall board may be sufficiently aligned such that very little time and expense are required to apply a finishing surface to the board. In at least one embodiment, the flexible member can be configured to align the board holder relative to a third building element. In at least one such embodiment, the first building element can include a block wall and the second building element can include a window frame, wherein the flexible member can be configured to align the board holder such that, when a drywall board is positioned in the board holder, the drywall board is at least substantially aligned with the block wall, the window frame, and/or a third building element, such as a stud wall, for example.

BRIEF DESCRIPTION OF THE DRAWINGS

The above-mentioned and other features and advantages of the various embodiments of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention, in one form, and such exemplifications are not to be construed as limiting the scope of the invention in any manner.

DETAILED DESCRIPTION

Certain exemplary embodiments will now be described to provide an overall understanding of the principles of the structure, function, manufacture, and use of the devices and methods disclosed herein. One or more examples of these embodiments are illustrated in the accompanying drawings. Those of ordinary skill in the art will understand that the devices and methods specifically described herein and illustrated in the accompanying drawings are non-limiting exemplary embodiments and that the scope of the various embodiments of the present invention is defined solely by the claims. The features illustrated or described in connection with one exemplary embodiment may be combined with the features of other embodiments. Such modifications and variations are intended to be included within the scope of the present invention.

Figure 6:
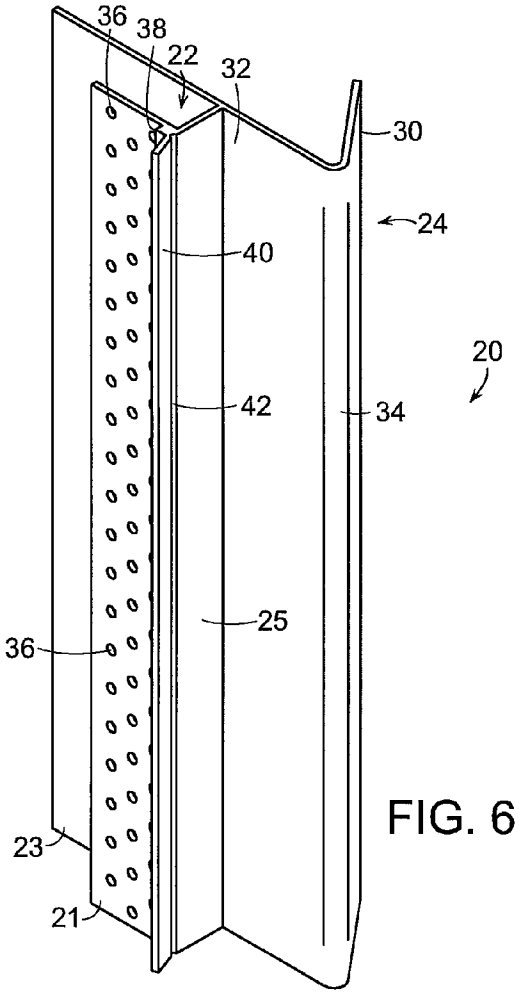
FIG. 6 is a perspective view of the board mount of FIG. 1.
Figure 8:
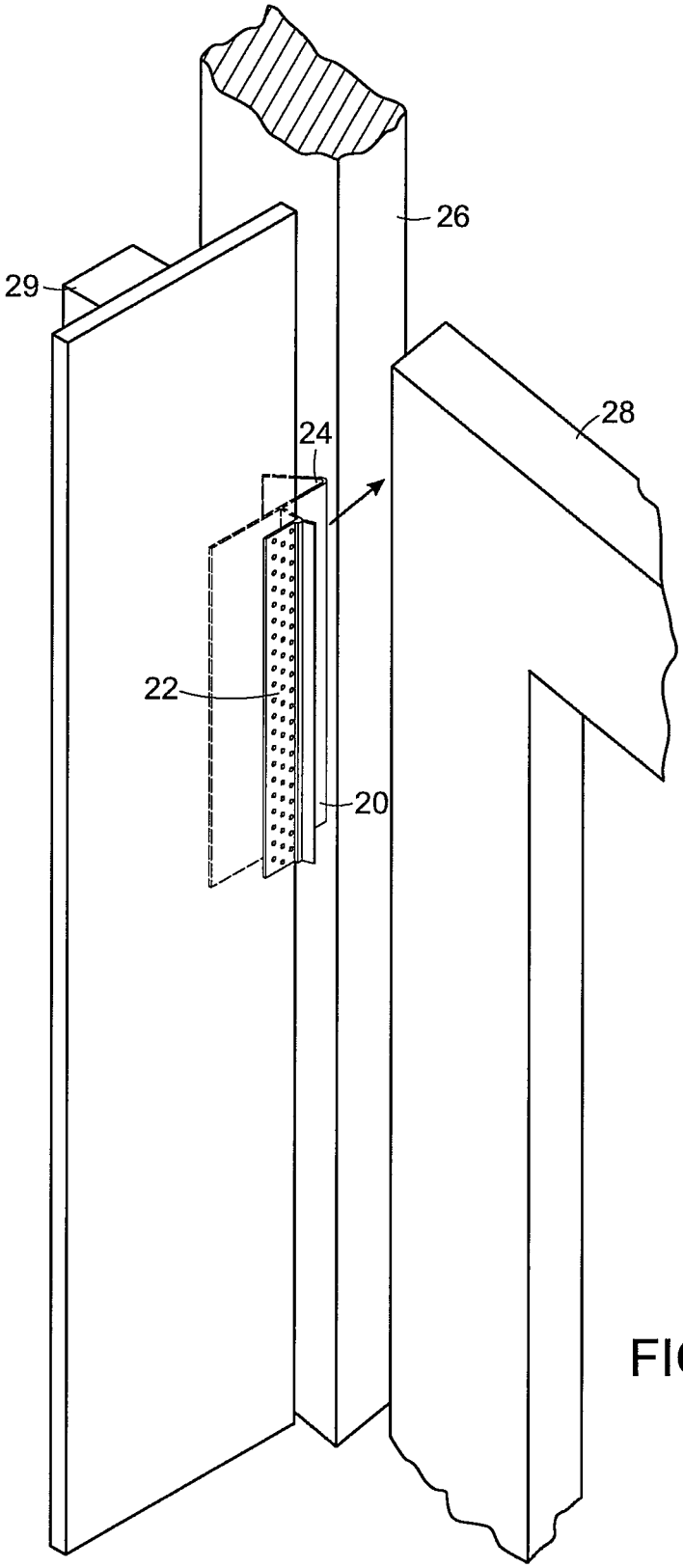
FIG. 8 is a view of the board mount of FIG. 1 being used to mount a board with respect to various building elements.

In various embodiments, at least one board mount can be utilized to retain, position, and/or align a board relative to a building element, such as a block wall, frame wall, and/or window frame, for example. In at least one embodiment, referring to FIG. 6, board mount 20 can include board receptor, or holder, 22 and flexible member 24. In use, referring to FIG. 8, flexible member 24 can be positioned intermediate first and second building elements, such as block wall 26 and window frame 28, for example. In various embodiments, flexible member 24 can include flange 30 which can be configured to pivot and/or flex relative to flange 32 about pivot 34. In at least one embodiment, flexible member 24 can be configured such that it can be deflected, or flexed, between a first configuration and a second configuration when it is positioned intermediate building elements 26 and 28, for example. In such circumstances, flexible member 24 can be configured to abut and apply a bearing load, or force, to building elements 26 and 28. Such bearing forces can create friction forces between flexible member 24 and building elements 26 and 28 which can retain board mount 20 in position. In various embodiments, these friction, or retention, forces can be sufficient to hold board mount 20 in position without the use of an adhesive and/or fasteners such as screws or nails, for example. In such embodiments, a laborer can insert one or more board mounts 20 between the first and second building elements in an expedient manner, although some embodiments are envisioned in which at least one fastener can be used to hold a board mount in position.

In various embodiments, flexible member 24 can comprise a spring, or spring analog, which can be configured to apply small bearing forces to building elements 26 and 28 when it is deflected a small amount and, correspondingly, apply larger bearing forces to building elements 26 and 28 when it is deflected a larger amount. In at least one such embodiment, flexible member 24 can comprise a linear, or substantially linear, spring element where the deflection of the spring and the load applied by the spring can be directly and linearly proportional. In addition to or in lieu of the above, flexible member 24 can include a spring, or spring analog, where the deflection of the spring and the load applied by the spring have a non-linear relationship, such as a sinusoidal and/or geometric relationship, for example. In either event, in various embodiments, flexible member 24 can be configured such that it can be retained within a gap regardless of the width of the gap. For example, flexible member 24 can deflect a large amount when it is positioned within small gaps, such as gaps having a width of approximately 0.125", for example, and, similarly, flexible member 24 can deflect a small amount when it is positioned in larger gaps, such as gaps having a width of approximately 1.375", for example. In various embodiments, a kit of board mounts can be provided to a laborer where the kit can include a plurality of board mounts having different board holders 22 configured to receive boards having different thicknesses and/or having different flexible members 24 configured to fit within gaps having different widths.

In use, a board, such as a drywall board, for example, can be positioned within board holder 22 after portion 24 has been positioned intermediate building elements 26 and 28, for example. Alternatively, the board can be positioned within board holder 22 before board mount 20 is positioned intermediate building elements 26 and 28. In either event, in various embodiments, board holder 22 can be configured to position and/or align the board relative to a building element. In at least one embodiment, board holder 22 can be configured to align the board relative to at least one of the first and second building elements holding board mount 20 in position. In various embodiments, board mount 20 can be configured such that board holder 22 aligns the board relative to a third building element, such as stud wall 29, for example. In such embodiments, board holder 22 can retain the board in alignment with stud wall 29 while a laborer nails, screws, or otherwise secures the board to stud wall 29. In various embodiments, board holder 22 can be configured to receive the board such that there is a clearance fit between the board and sidewalls 21 and 23 of board holder 22. In at least one such embodiment, an edge of the board can be slid into board holder 22 until the board contacts base 25 or is otherwise suitably positioned within board holder 22. In other various embodiments, board holder 22 can be configured such there is an interference fit between the board and sidewalls 21 and 23 of board holder 22. In such embodiments, board holder 22 can clamp, grasp, and/or hold the board in position.

In various embodiments, as described above, a board mount can be configured to align and/or position a board relative to one or more building elements. In at least one such embodiment, the entire length of flexible member 24 can be configured to deflect a uniform, or at least substantially uniform, amount when it is inserted between two building elements in order to align board holder 22, and the board received therein, with the building elements. In various circumstances, the building elements may be arranged such that the optimum alignment of the board is such that the board is not perfectly aligned with any of the building elements. More particularly, in at least one embodiment, the first and second building elements may be arranged, or sufficiently misaligned, such that when, retention, or alignment, member 24 of board mount 20 is positioned intermediate the first and second building elements, board holder 22 is oriented such that a board positioned within board holder 22 appears to be substantially aligned, or at least not grossly misaligned, with the surrounding misaligned building elements. In such embodiments, less finishing compound may be required to make the board and the building elements appear to be aligned. In various embodiments, especially in embodiments in which the gap between the building elements is angled and/or not uniform, for example, flexible member 24 can be configured such that various portions of flexible member 24 can deflect or flex different distances. For example, depending on the configuration of the gap between the building elements, a first portion of flexible member 24 can be configured to deflect or flex a first distance and a second portion of flexible member 24 can be configured to deflect or flex a second distance. In such circumstances, flexible member 24 can be configured to align board holder 22 in an intermediate position or alignment between the building elements.

Figure 1:
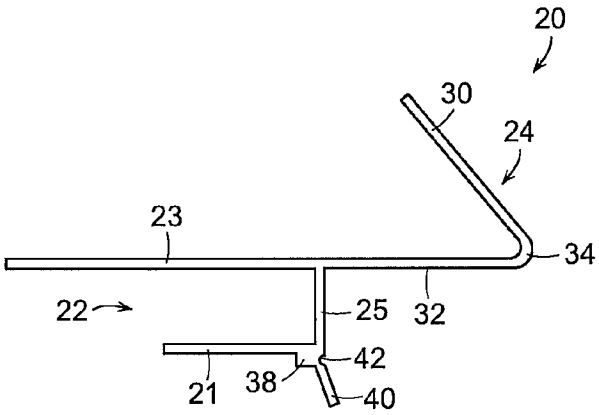
FIG. 1 is a side view of a board mount in accordance with one non-limiting embodiment of the present invention.
Figure 2:
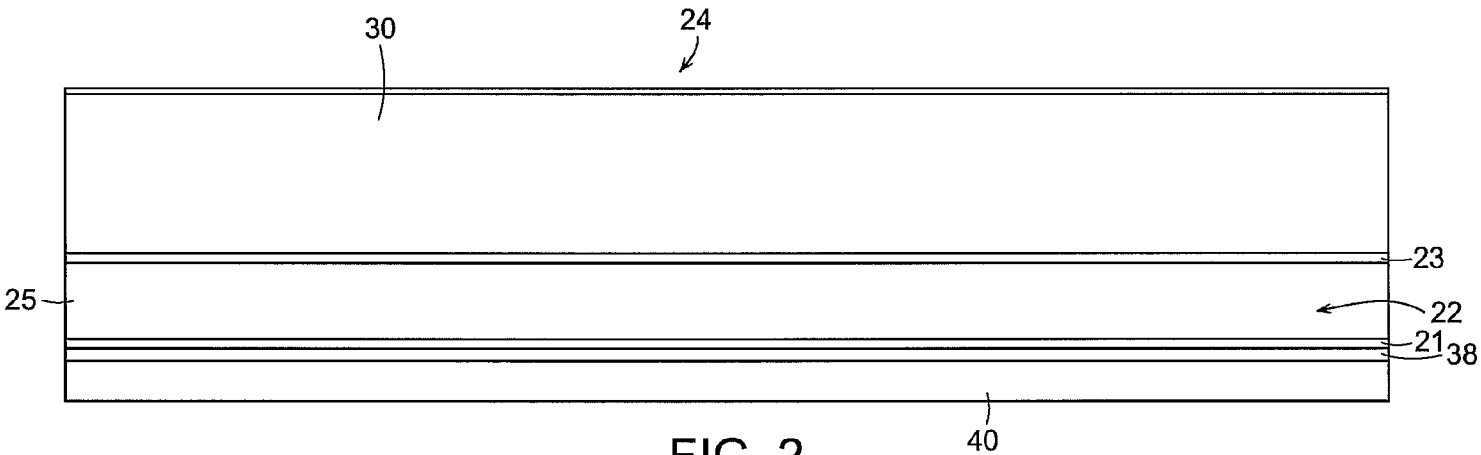
FIG. 2 is a front view of the board mount of FIG. 1.
Figure 3:
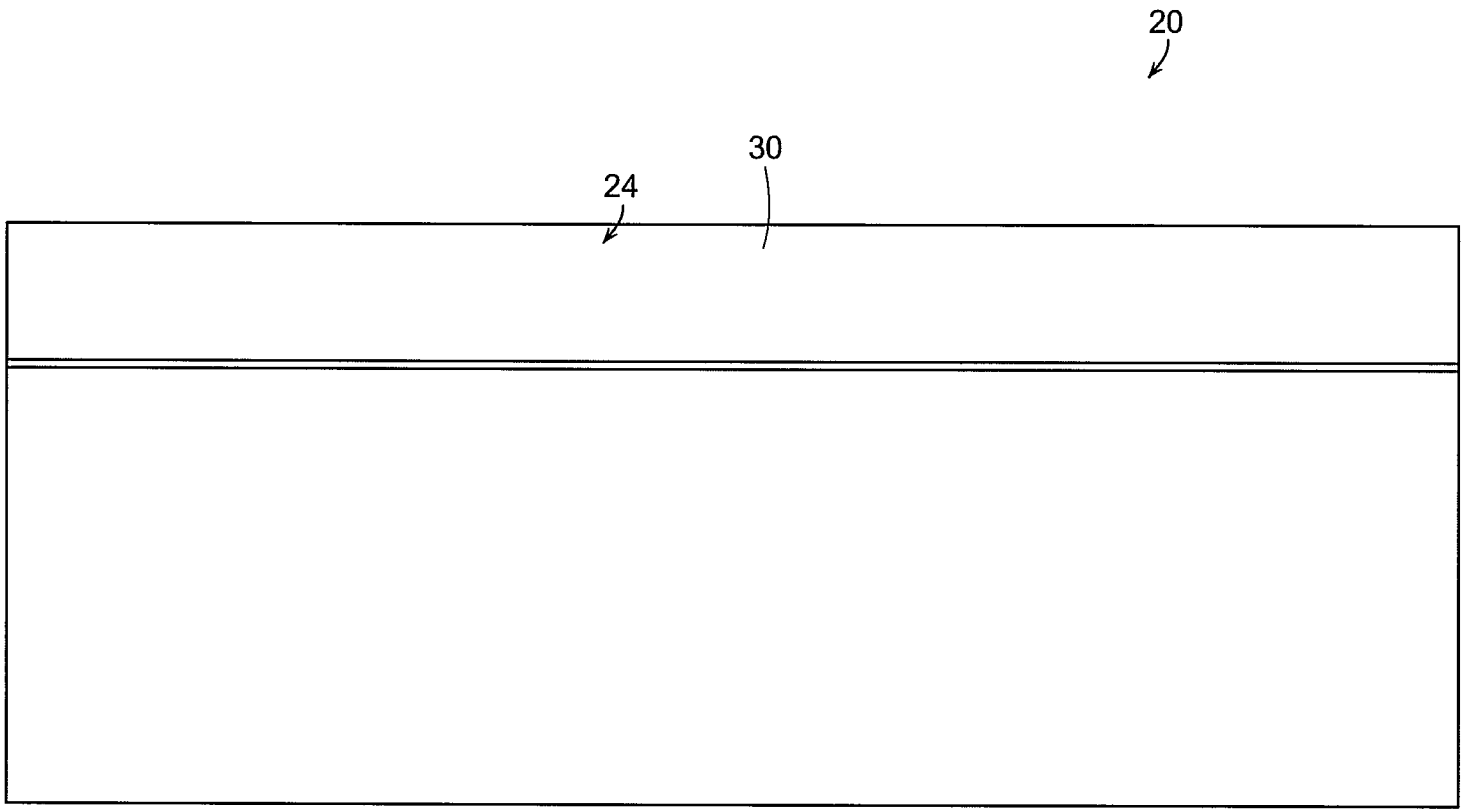
FIG. 3 is a top view of the board mount of FIG. 1.
Figure 4:
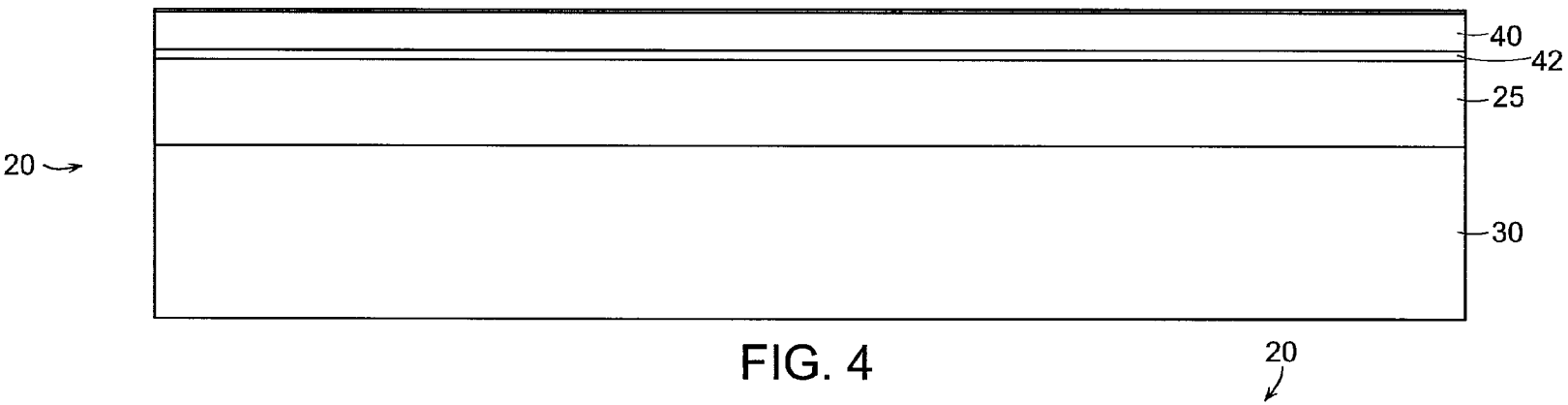
FIG. 4 is a rear view of the board mount of FIG. 1.
Figure 5:
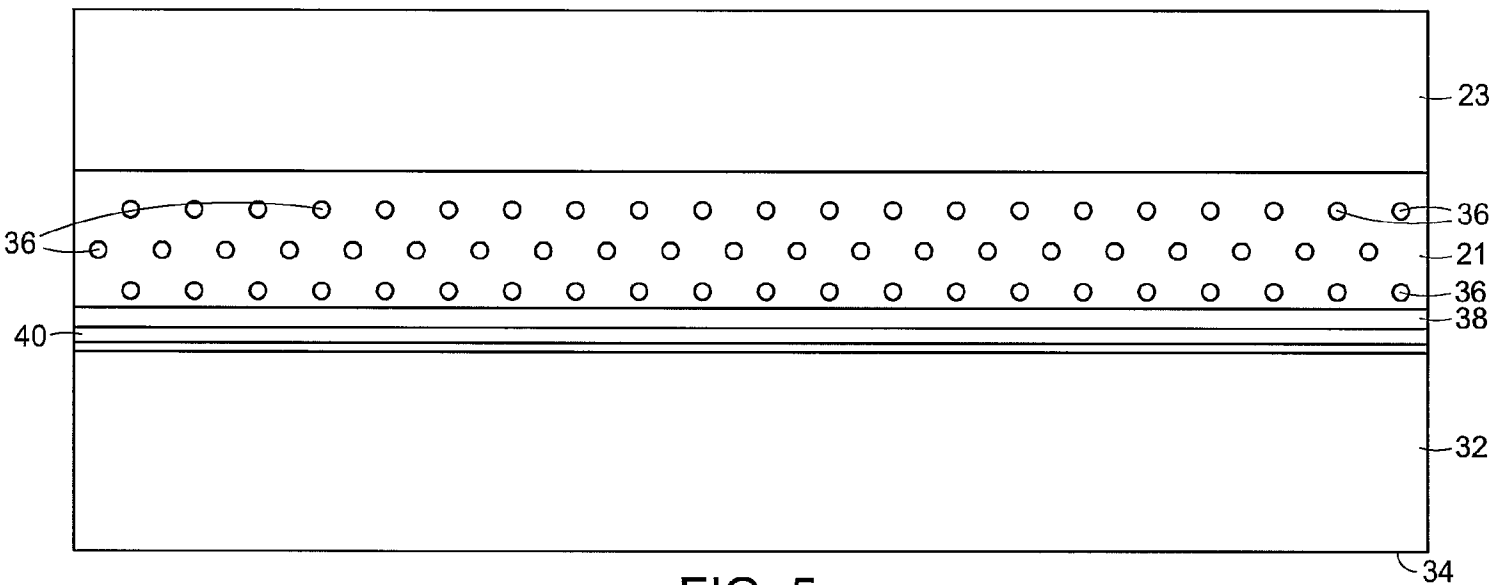
FIG. 5 is a bottom view of the board mount of FIG. 1.
Figure 7:
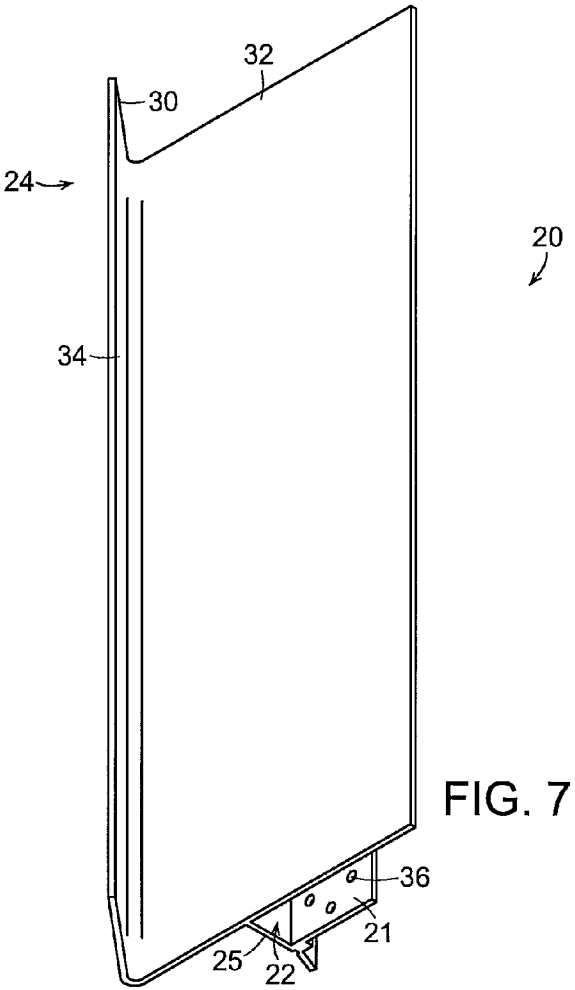
FIG. 7 is another perspective view of the board mount of FIG. 1.

After the board has been secured in position, a finishing compound, such as joint compound, mud, and/or plaster, for example, can be applied to the board and/or board mount 20. In various embodiments, joint compound can be applied to the board and board mount 20 such that the joint compound covers at least a portion of side wall 21, for example. In such circumstances, the joint compound can create a smooth transition between a front surface of the board and the outside surface of side wall 21. In at least one embodiment, referring to FIG. 5, side wall 21 can include at least one hole, or perforation, 36 configured to receive joint compound therein. In at least one such embodiment, holes 36 can improve the adhesion between the joint compound and side wall 21 and thereby reduce the possibility that the joint compound may crack. In various embodiments, referring to FIG. 1, board mount 20 can further include finish stop, or datum, 38 which can assist a laborer in feathering-in the level of the joint compound with a trowel, for example. In at least one embodiment, again referring to FIG. 1, board mount 20 can further include at least one removable member, such as removable strip 40, for example, which can assist in providing an attractive, finished edge between the joint compound and board mount 20. More particularly, a laborer may often apply a quantity of joint compound over finish stop 38 onto strip 40 and, in such circumstances, the laborer can grab an end of removable strip 40 and tear strip 40 away from base 25 of board holder 22. As a result, the removal of strip 40 can create a 'clean' visible edge which is more often aesthetically pleasing than an uneven edge of joint compound, for example. In at least one embodiment, board mount 20 can further include at least one score mark which can provide a pre-determined path along which strip 40 may tear away from board mount 20. In various embodiments, board mount 20 can further include a notch, score mark, or any other suitable portion having a reduced cross-section, 42 which can allow strip 40 to be more easily removed from board mount 20.

In various embodiments, the board mounts described herein, including mount 20, can be comprised of any suitable material such as plastic and/or metal, for example. The board mounts described herein can also be manufactured using any suitable manufacturing process. In various embodiments, board mount 20, for example, can be manufactured using a plastic extrusion process. In at least one embodiment, a billet of plastic material, such as vinyl, for example, can be loaded into an extrusion press and the plastic material can be forced through a die to create an elongate strip of extruded material having the cross-section of board mount 20. Thereafter, the elongate strip can be cut in order to create a plurality of board mounts 20 having a desired length. In other various embodiments, portions of board mount 20, for example, can be separately manufactured and then assembled together. In at least one such embodiment, board holder 22, including base 25 and side walls 21 and 23, can be extruded in a first manufacturing process and a separate component comprising flanges 30 and 32 can be extruded in a second manufacturing process, wherein such components can be assembled together using an adhesive and/or a plastic welding or heat-staking process, for example. In other various embodiments, any of the above-described plastic extrusion manufacturing processes can be replaced with a plastic injection molding process. In various embodiments, sheets of metal, such as stainless steel, for example, can be bent into any suitable configuration in order to manufacture a board mount or any suitable portion of a board mount. In at least one such embodiment, board holder 22 and a component comprising flanges 30 and 32 can be separately manufactured and then welded together, for example.

In any event, the material comprising, and/or the dimensions of, flexible member 24 can be selected so as to provide flexible member 24 with a suitable spring stiffness such that it can generate a suitable bearing, or retention, force as described above. In various circumstances, the elastic and damping properties of flexible member portion 24 can be selected such that board mount 20 can absorb vibrations, and/or impact loads, applied thereto and/or the building elements surrounding board mount 20. More particularly, especially in earthquake prone areas, it is often desirable to have components positioned intermediate building elements which can absorb and/or dissipate vibrational or shock energy created by earthquakes. In various embodiments, board mount 20, especially flexible member portion 24, can be configured to absorb such energy and thereby reduce the possibility that the board mount, board, and/or joint compound placed thereover will rip and/or crack. In various embodiments, although board mount 20 can be utilized to position, retain, and/or align a drywall board, for example, board mounts are envisioned which can be configured to position, retain, and/or align other boards such as plywood, for example.

While this invention has been described as having exemplary designs, the present invention may be further modified within the spirit and scope of the disclosure. This application is therefore intended to cover any variations, uses, or adaptations of the invention using its general principles. Further, this application is intended to cover such departures from the present disclosure as come within known or customary practice in the art to which this invention pertains. Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference.

What is claimed is:

1. A mount for positioning a board, comprising:

a board receiver configured to receive a portion of the board, wherein said board receiver comprises a channel, and wherein said channel comprises a first side wall and a second side wall;

a retention member configured to retain said board receiver relative to one of a first building element and a second building element, wherein said retention member extends from said first side wall of said channel;

wherein said second sidewall comprises a finishing surface, and wherein said finishing surface comprises an array of openings configured to receive a finishing compound;

a finishing stop extending from said second sidewall, wherein said finishing stop extends along said openings; and a removable member extending along said finishing stop.

2. The mount of claim 1, wherein said retention member comprises a first portion, a second portion, and a joint hingedly connecting said first portion and said second portion, wherein said second portion comprises a free end and a second end attached to said first portion by said joint, and wherein said joint comprises a distal wedge tip configured to be driven intermediate the first and second building elements.

3. The mount of claim 1, wherein said removable member protrudes from said second side wall; and wherein said mount further comprises a notch which can be configured to define a pre-determined path along which said removable member can detach from said second side wall.

* * * * *